US008224216B2

(12) United States Patent
Ikami et al.

(10) Patent No.: US 8,224,216 B2
(45) Date of Patent: Jul. 17, 2012

(54) DEVELOPING APPARATUS

(75) Inventors: Jun Ikami, Nagoya (JP); Masateru Kawamura, Toyoake (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 859 days.

(21) Appl. No.: 12/112,509

(22) Filed: Apr. 30, 2008

(65) Prior Publication Data

US 2008/0292362 A1 Nov. 27, 2008

(30) Foreign Application Priority Data

May 8, 2007 (JP) ..... 2007-123497

(51) Int. Cl.
*G03G 15/08* (2006.01)

(52) U.S. Cl. ..... 399/265

(58) Field of Classification Search ..... 399/265
See application file for complete search history.

(56) References Cited

U.S. PATENT DOCUMENTS

| | | | | |
|---|---|---|---|---|
| 6,597,884 | B2 * | 7/2003 | Miyaguchi et al. | 399/266 |
| 2005/0089778 | A1 * | 4/2005 | Nagase et al. | 430/45 |

FOREIGN PATENT DOCUMENTS

| | | | |
|---|---|---|---|
| JP | 59-176755 | | 10/1984 |
| JP | 2002-091159 | | 3/2002 |
| JP | 2002-091942 | | 3/2002 |
| JP | 2002-287495 | | 10/2002 |
| JP | 2005-077589 | A | 3/2005 |
| JP | 2007-102082 | A | 4/2007 |

* cited by examiner

*Primary Examiner* — David Porta
*Assistant Examiner* — Carolyn Igyarto
(74) *Attorney, Agent, or Firm* — Banner & Witcoff, Ltd.

(57) ABSTRACT

A developing apparatus is described. The developing apparatus includes a transport member including a plurality of electrodes forming a traveling wave electric field by successively applied voltages and a casing storing a toner transported by the transport member, wherein the activity of the toner based on the following measuring method shown in (1) to (3) is not more than $2.0\times10^{-6}$ mol/g: (1) dipping the toner in an aqueous solution containing an excess equivalent of benzethonium chloride with respect to electrostatically active polar groups present on the surface of the toner to electrostatically react the polar groups and the benzethonium chloride with each other; (2) adding sodium lauryl sulfate dropwise to the aqueous solution to react the same with the residual benzethonium chloride, thereby measuring the quantity of the sodium lauryl sulfate reacting with the residual benzethonium chloride; and (3) calculating the activity on the surface of the toner from the quantity of the reacting sodium lauryl sulfate.

5 Claims, 4 Drawing Sheets

1

DEVELOPING APPARATUS

CROSS REFERENCE TO RELATED APPLICATION

This application claims priority to Japanese Patent Application No. 2007-123497 filed on May 8, 2007, the disclosure of which is hereby incorporated into the present application by reference.

Technical Field

The present invention relates to a developing apparatus employed for developing with a toner.

BACKGROUND

An image forming apparatus such as a copying machine, a printer or a facsimile forms an electrostatic latent image on a photosensitive drum and develops the electrostatic latent image with a toner, thereby forming a visible image.

Such an image forming apparatus is provided with a developing apparatus for storing the toner and feeding the same to the photosensitive drum. In general, the developing apparatus transports the toner to the photosensitive drum with a developing roller.

Further, various types of developing apparatuses transporting an electrostatically charged toner to a photosensitive drum through the action of an electric field are proposed.

When the toner is transported through the action of an electric field, friction caused on the transported toner can be reduced, and deterioration of the toner can be suppressed.

However, the toner cannot be transported through the electric field unless the same is precharged even using the above-mentioned transportation method. Precharging inevitably results in friction, and hence the toner is disadvantageously somewhat deteriorated.

SUMMARY

One aspect of the present invention may provide a developing apparatus capable of transporting a toner through the action of an electric field without precharging the toner.

The same or different aspect of the present invention may provide a developing apparatus including a transport member including a plurality of electrodes forming a traveling wave electric field by successively applied voltages and a casing storing a toner transported by the transport member, wherein the activity of the toner based on the following measuring method shown in (1) to (3) is not more than $2.0\times10^{-6}$ mol/g: (1) dipping the toner in an aqueous solution containing an excess equivalent of benzethonium chloride with respect to electrostatically active polar groups present on the surface of the toner to electrostatically react the polar groups and the benzethonium chloride with each other; (2) adding sodium lauryl sulfate dropwise to the aqueous solution to react the same with the residual benzethonium chloride, thereby measuring the quantity of the sodium lauryl sulfate reacting with the residual benzethonium chloride; and (3) calculating the activity on the surface of the toner from the quantity of the reacting sodium lauryl sulfate.

DETAILED DESCRIPTION

Figure 1:
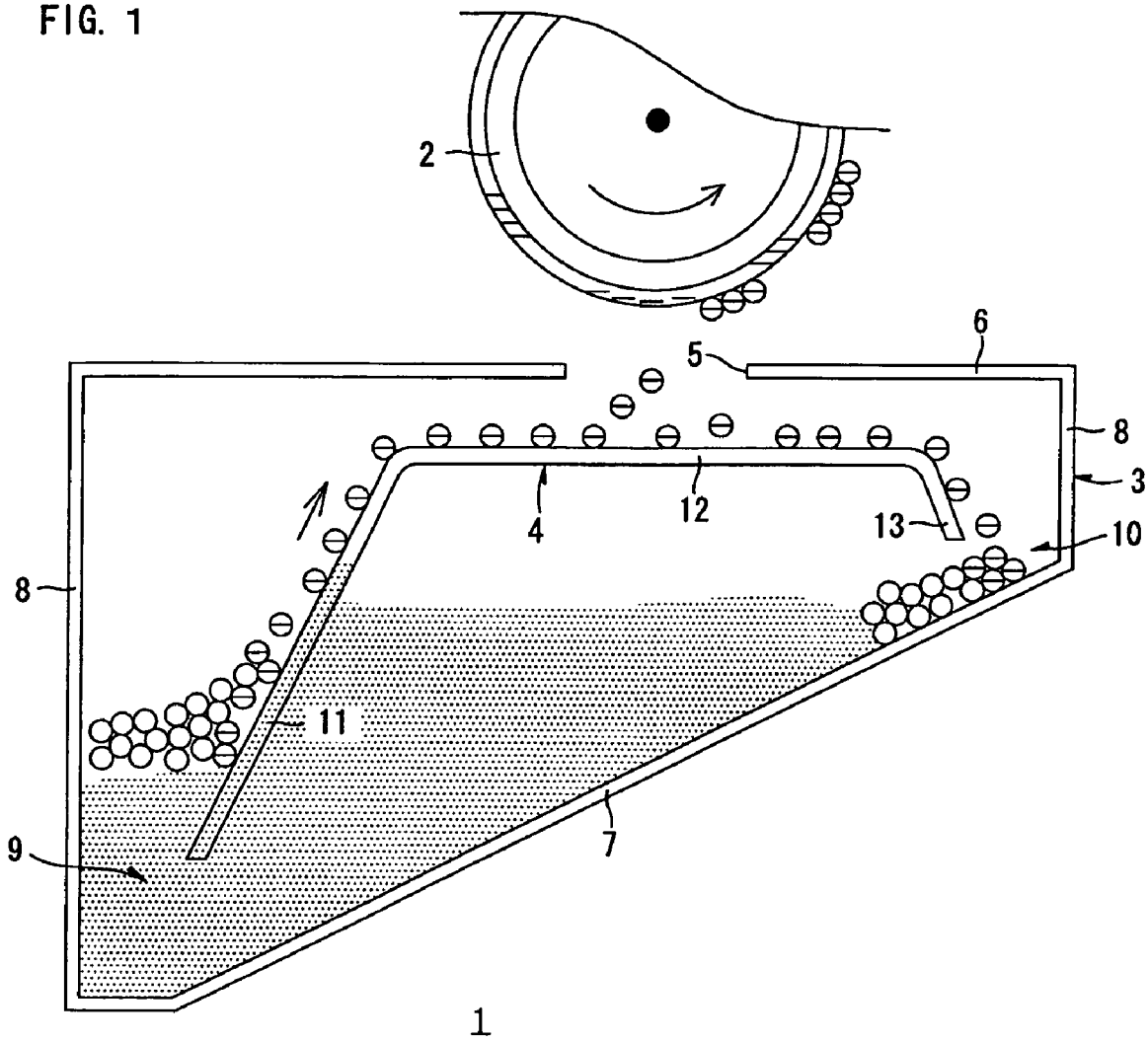
FIG. 1 is a schematic side sectional view showing an embodiment of a developing apparatus according to the present invention.

An embodiment of the present invention is now described with reference to the drawings.

1. Toner

According to this embodiment, a toner having activity of not more than $2.0\times10^{-6}$ mol/g is employed.

(1) Method of Measuring Activity of Toner

The activity of the toner can be measured by preparing a sample solution and back-titrating the sample solution according to the following method.

(Preparation of Sample Solution)

The sample solution is prepared as follows: First, 0.1 to 10 g f the toner is introduced into a weighed vessel, and the input (g) of the toner is thereafter calculated by weighing the vessel. The input of the toner is selected from such a range that the toner is dispersible after the introduction into the vessel and the equivalent amount of polar groups does not exceed the equivalent amount of subsequently added benzethonium chloride.

Thereafter 0.05 to 30 mL of aqueous benzethonium chloride solution of 0.001 to 0.1 mol/L is added to the vessel, to dip the toner in this aqueous benzethonium chloride. Thereafter the vessel is weighed. The molar concentration and the volume of the aqueous benzethonium chloride solution are selected from such ranges that the toner can be dispersed therein and the equivalent amount of benzethonium chloride is in excess of that of the polar groups.

The aqueous benzethonium chloride solution is added to the vessel so that electrostatically active polar groups present on the surface of the toner electrostatically react with the benzethonium chloride. The benzethonium chloride electrostatically reacts with the electrostatically active polar groups present on the surface of the toner, but is inhibited from reacting with electrostatically inactive polar groups present on the surface of the toner and electrostatically active or inactive polar groups present in the toner. Therefore, unlike neutralization, the benzethonium chloride is consumed not by all polar groups present in the toner but consumed by the electrostatically active polar groups actually contributing to charging.

Thereafter the vessel is shaken with an ultrasonic cleaner or the like to disperse the toner in the aqueous benzethonium chloride solution, and the vessel is thereafter weighed with addition of 3 to 300 ml of water, to calculate the input of water. This water may be distilled water or ion-exchange water. The input of water is selected from a quantity allowing the entire liquid to flow after the introduction of water.

Then, the toner is stirred for 0.5 to 60 minutes so that the entire liquid flows. Thereafter the quantity of evaporated water is calculated by weighing the vessel.

Thereafter the entire liquid is filtrated through a filter and the filtrate is received in a previously weighed vessel, to calculate the weight of the filtrate by weighing the vessel immediately after the filtration. The filter is formed by a membrane filter of 0.1 to 3 μm, for example. In this filtration, evaporation of the aqueous benzethonium chloride solution should be minimized. Thereafter water is added to the vessel so that the volume of the liquid is 30 to 500 mL, thereby preparing the sample solution.

(Titration)

Then, the sample solution is titrated with aqueous sodium lauryl sulfate solution having a concentration of 0.05 to 1 time the concentration of the benzethonium chloride, and the titer of the aqueous sodium lauryl sulfate solution is measured. The molar concentration of the aqueous sodium lauryl sulfate solution is selected from such a range that the end point (inflection point) can be precisely obtained.

The method of titration is not particularly limited so far as the end point can be obtained. The aqueous sodium lauryl sulfate solution may be manually added to the sample solution dropwise from a burette using an indicator, or a commercially available titrator such as a potentiometric titrator may be employed.

The sodium lauryl sulfate quantitatively causes equimolar reaction with the rest of the benzethonium chloride reacting with the polar groups, due to the titration. Therefore, the titration reaches the end point when the sodium lauryl sulfate is consumed by the benzethonium chloride, and the titer of the aqueous sodium lauryl sulfate solution added dropwise up to this moment corresponds to the reacting amount of sodium lauryl sulfate.

(Calculation)

Then, the activity of the polar groups on the surface of the toner is calculated from the titer of the aqueous sodium lauryl sulfate solution in the following manner:

First, a mole number W (mol) of the sodium lauryl sulfate consumed by titration is calculated from the following equation (1):

$$W = \text{concentration(mol/L) of aqueous sodium lauryl sulfate solution} \times (\text{titer(mL)}/1000) \quad (1)$$

Then, a loss upon filtration caused when preparing the sample solution is corrected with respect to the mole number W of the sodium lauryl sulfate in the following manner.

First, a total volume T (ml) before the filtration is calculated from the following equation (2). In the following calculation, the volume is converted from the measured weight.

$$T = \text{input (ml) of aqueous benzethonium chloride solution} + (\text{input (ml) of water} - \text{quantity (ml) of evaporated water}) \quad (2)$$

Then, a mole number X (mol) of the benzethonium chloride contained before the filtration is calculated from the following equation (3), by correcting the loss upon filtration with respect to the mole number W of the sodium lauryl sulfate. Benzethonium chloride and sodium lauryl sulfate react with equivalent amounts of 1 mole vs. 1 mole. When the loss upon filtration is corrected with respect to the mole number W of the sodium lauryl sulfate, therefore, the mole number X of the benzethonium chloride contained before the filtration is calculated.

$$X = W(\text{mol}) \times T(\text{ml})/\text{volume of filtrate(ml)} \quad (3)$$

Then, the mole number X (mol) of the benzethonium chloride contained before the filtration is subtracted from the mole number (mol) of the initially added benzethonium chloride, thereby calculating a mole number Y (mol) of the benzethonium chloride consumed by the reaction with the polar groups from the following equation (4). The mole number Y of the benzethonium chloride consumed by the reaction with the polar groups corresponds to the quantity of the electrostatically active polar groups.

$$Y = \text{concentration(mol/L) of aqueous benzethonium chloride solution} \times \text{input(ml) of aqueous benzethonium chloride solution}/1000 - X \quad (4)$$

Finally, the mole number Y (mol) of the benzethonium chloride consumed by the reaction with the polar groups is converted to a value per unit weight, and this value is calculated as an activity Z of the toner.

$$Z = Y(\text{mol})/\text{input(g) of toner}$$

(Activity of Toner)

According to the aforementioned method, the benzethonium chloride electrostatically reacts with the electrostatically active polar groups present on the surface of the toner, but is inhibited from reacting with the electrostatically inactive polar groups present on the surface of the toner and the electrostatically active or inactive polar groups present in the toner. Therefore, unlike neutralization, the benzethonium chloride is consumed not by all polar groups present in the toner but consumed by the electrostatically active polar groups actually contributing to charging. Consequently, the activity of the polar groups actually contributing to charging can be evaluated.

(2) Method of Preparing Toner

The toner can be prepared by the following method, for example, although the method is not particularly limited so far as the activity of the toner measured by the aforementioned method is not more than $2.0\times10^{-6}$ mol/g.

(a) Process of Preparing Resin Solution

First, a resin solution is prepared by blending binder resin and a colorant, and an additive if necessary, into an organic solvent.

(Binder Resin)

The binder resin is the main component of the toner, and contains synthetic resin fixed (thermally fused) onto the surface of a recording medium (such as a paper or an OHP sheet) by heating and/or pressurization.

This binder resin is not particularly limited but selected from synthetic resin known as a binder resin for a toner. For example, the binder resin can be selected from polyester resin, styrene resin (styrene such as polystyrene, poly-p-chlorostyrene or polyvinyltoluene or a derivative thereof, a styrene-styrene derivative copolymer such as a styrene-p-chlorostyrene copolymer or a styrene-vinyltoluene copolymer, a styrene copolymer such as a styrene-vinylnaphthalene copolymer, a styrene-acrylic acid copolymer, a styrene-methacrylic acid copolymer, a styrene-α-chloromethyl methacrylate copolymer, a styrene-acrylonitrile copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer or a styrene-acrylonitrile-indene copolymer), acrylic resin, methacrylic resin, polyvinyl chloride resin, phenolic resin, natural modified phenolic resin, natural modified maleic resin, vinyl polyacetate, silicone resin, polyurethane resin, polyamide resin, furan resin, epoxy resin, polyvinyl butyral resin, terpene resin, coumarone-indene resin, petroleum resin or the like. These can be used alone or in combination.

The binder resin preferably has hydrophilic groups. If the binder resin has hydrophilic groups, no surfactant may be blended when preparing an emulsion. Cationic groups such as quaternary ammonium groups, quaternary ammonium salt-containing groups, amino groups or phosphonium salt-containing groups, or anionic groups such as carboxyl groups or sulfonic groups can be listed as the hydrophilic groups.

Preferably, binder resin having anionic groups, more preferably polyester resin having anionic groups, particularly preferably polyester resin having carboxyl groups (polyester resin having an acid value) can be listed.

The aforementioned polyester resin having carboxyl groups is on the market today, and polyester resin having an acid value of 2 to 15 mgKOH/g, preferably 4 to 7 mgKOH/g, a weight-average molecular weight (according to GPC measurement with a calibration curve of standard polystyrene) of 3000 to 200000, preferably 50000 to 100000 and a crosslinking content (THF insoluble) of not more than 10 percent by weight, preferably not more than 5 percent by weight, is employed, for example.

(Colorant)

The colorant is for giving a desired color to the toner, and is dispersed or penetrated into the binder resin. The colorant may be carbon black, an organic pigment such as quinophthalone yellow, Hansa yellow, isoindolinone yellow, benzidine yellow, perynone orange, perynone red, perylene maroon, rhodamine 6G lake, quinacridone red, rose bengal, copper phthalocyanine blue, copper phthalocyanine green or a diketopyrrolopyrrole pigment, an inorganic pigment or metallic powder such as titanium white, titanium yellow, ultramarine, cobalt blue, red iron oxide, aluminum powder or bronze, an oil soluble dye or a dispersion dye such as an azo dye, a quinophthalone dye, an anthraquinone dye, a xanthene dye, a triphenylmethane dye, a phthalocyanine dye, an indophenol dye or an indoaniline dye, or a rosin dye such as rosin, rosin-modified phenol or rosin-modified maleic rein, for example. Alternatively, the colorant can be prepared from a dye or a pigment processed with higher fatty acid or resin.

These colorants can be used alone or in combination, according to the desired color. For example, a chromatic single-colored toner can be prepared by blending a pigment and a dye of the same color such as a rhodamine pigment and a rhodamine dye, a quinophthalone pigment and a quinophthalone dye or a phthalocyanine pigment and a phthalocyanine dye, for example.

The colorant is blended in the ratio of 2 to 20 parts by weight, for example, preferably 3 to 15 parts by weight with respect to 100 parts by weight of the binder resin.

(Additive)

The additive is prepared from wax, for example. The wax is added in order to improve the fixability of the toner to the recording medium. The wax may be ester wax or hydrocarbon wax, for example.

The ester wax may be an aliphatic ester compound such as stearate ester or palmitate ester, for example, or a multifunctional ester compound such as pentaerythritol tetramyristate, pentaerythritol tetrapalmitate or dipentaerythritol hexapalmitate, for example.

The hydrocarbon wax may be polyolefin wax such as low molecular weight polyethylene, low molecular weight polypropylene or low molecular weight polybutylene, natural vegetable wax such as candelilla wax, carnauba wax, rice, Japan wax or jojoba, petroleum wax such as paraffin wax, microcrystalline wax or petrolatum or modified wax thereof, or synthetic wax such as Fischer-Tropsch wax, for example.

The wax may also be colorant-containing wax containing (involving) the aforementioned colorant.

These waxes can be used alone or in combination.

The wax is blended in the ratio of 1 to 20 parts by weight, for example, preferably 3 to 15 parts by weight with respect to 100 parts by weight of the binder resin.

(Organic Solvent)

The organic solvent is not particularly limited, but may be ester such as ethyl acetate or butyl acetate, glycol such as ethylene glycol, diethylene glycol, ethylene glycol monomethyl ether or diethylene glycol monomethyl ether, ketone such as acetone, methyl ethyl ketone (MEK) or methyl isobutyl ketone, or ether such as tetrahydrofuran (THF), for example. These organic solvents can be used alone or in combination.

The organic solvent is blended in the ratio of 50 to 2000 parts by weight, for example, preferably 250 to 800 parts by weight with respect to 100 parts by weight of the binder resin.

(Preparation of Resin Solution)

In order to prepare the resin solution, the binder resin and the colorant, and the additive if necessary, are blended into the organic solvent in the aforementioned ratios. After the components are blended into the organic solvent, the mixture is shaken for 15 to 60 minutes, for example, and further stirred for 30 to 180 minutes, for example. If gel is formed, the mixture is further dispersively stirred with a high-speed stirrer such as a homogenizer for 10 to 30 minutes, for example. The resin solution is prepared in this manner.

(b) Step of Preparing Emulsion

Then, an emulsion is prepared by blending the resin solution into an aqueous medium.

(Aqueous Medium)

The aqueous medium may be water or an aqueous medium in which some water-soluble solvent (alcohol, for example) or an additive (surfactant or dispersant, for example) is blended to a main component of water. The aqueous medium is prepared as aqueous alkali solution when the binder resin having anionic groups is employed, for example. The aqueous alkali solution may be an aqueous organic base solution obtained by dissolving a basic organic compound such as amine in water, or an aqueous inorganic base solution obtained by dissolving alkaline metal such as sodium hydroxide or potassium hydroxide in water, for example.

For example, the aqueous inorganic base solution contains a basic substance having a mole number of 0.1 to 1 time, preferably 0.2 to 0.6 time of the KOH mole number (i.e., acid value×resin content) necessary for neutralizing the entire resin contained in the resin solution, and is prepared as aqueous sodium hydroxide solution or aqueous potassium hydroxide solution of 0.001 to 0.1 N (normal), for example, preferably 0.005 to 0.05 N (normal).

(Preparation of Emulsion)

In order to prepare the emulsion, 50 to 100 parts by weight, preferably 80 to 100 parts by weight of the resin solution is blended into 100 parts by weight of the aqueous medium, for example.

Then, the aqueous medium blended with the resin solution is stirred with a high-speed disperser such as a homogenizer, for example, at a tip circumferential velocity of 5 to 30 m/s, preferably 8 to 20 m/s, for 5 to 40 minutes, preferably 10 to 30 minutes. Then, the resin solution is emulsified in the aqueous medium as droplets, to form the emulsion.

(c) Process of Preparing Suspension

Then, the organic solvent is removed from the emulsion to obtain a suspension. The organic solvent is removed from the emulsion by a well-known method such as ventilation, heating, decompression or a combination thereof. For example, the emulsion is heated and stirred at the room temperature to 90° C., preferably 50 to 80° C., and the liquid surface is ventilated. Then, the organic solvent is removed from the aqueous medium, and the suspension (slurry) is prepared in which particles of the binder resin with the colorant (and the additive) dispersed are dispersed in the aqueous medium.

Thereafter the suspension is stirred and cooled, and diluted with water so that the solid concentration of the suspension (the concentration of the resin particles in the suspension) is 5 to 50 percent by weight, for example, preferably 10 to 30 percent by weight.

(d) Aggregation and Fusing Process

Then, a aggregator is added to the suspension for aggregating the resin particles and the aggregated resin particles are thereafter fused by heating, thereby growing the particle diameters of the resin particles and obtaining toner base particles.

The aggregator may be inorganic metallic salt such as calcium nitrate, for example, or a polymer of inorganic metallic salt such as polyaluminum chloride, for example.

While a method of stirring the suspension is not particularly limited, the suspension is first dispersed with a high-speed disperser such as a homogenizer, for example.

Then, a defoaming agent and alkali are added to the suspension within 10 minutes, preferably within 1 minute, after the addition of the aggregator, and the mixture is stirred. In order to stir the mixture, ultrasonic waves can be applied if necessary.

The defoaming agent may be an anionic surfactant. The defoaming agent is prepared as an aqueous defoaming solution of 0.01 to 1 percent by weight, for example, and 50 to 200 parts by weight, for example, preferably 70 to 150 parts by weight, of this aqueous defoaming solution is added to 100 parts by weight of the suspension.

The alkali can be prepared from a basic organic compound such as amine, or alkaline metal hydroxide such as aqueous sodium hydroxide or potassium hydroxide, for example. The alkali is prepared as aqueous alkali of 0.5 to 10 percent by weight, and 0.01 to 5 parts by weight, for example, preferably 0.05 to 2 parts by weight, of this aqueous alkali solution is added with respect to 100 parts by weight of the suspension.

Alternatively, an aqueous solution containing the defoaming agent and the alkali can be prepared and added to 100 parts by weight of the suspension.

Thereafter the components are mixed with a stirrer provided with a mixing blade, to entirely fluidize the suspension. As the mixing blade, a well-known blade such as a flat turbine blade, a propeller blade or an anchor blade may be used. The tip circumferential speed of the mixing blade is 0.8 to 10 m/s, for example, preferably 1 to 5 m/s, the liquid temperature in stirring is 20 to 60° C., for example, preferably 40 to 50° C., and the stirring time is 5 to 180 hours, for example, preferably 20 to 60 hours.

Thereafter a aggregation terminator is added for terminating the aggregation process, and the aggregated resin particles are fused by heating.

The aggregation terminator may be alkaline metal such as sodium hydroxide or potassium hydroxide, for example.

0.5 to 10 parts by weight, for example, preferably 1 to 3 parts by weight, of aqueous alkaline metal solution prepared to 0.01 to 1 N (normal), for example, preferably 0.1 to 0.5 N (normal), is added with respect to 100 parts by weight of the suspension, and the mixture is continuously stirred.

Thereafter the mixture is heated at a temperature higher by 20 to 100° C., for example, preferably by 30 to 60° C., than the glass transmission temperature of the resin for 60 to 600 hours, for example, preferably 60 to 420 hours. Thus, the aggregated resin particles are fused to obtain generally circular toner base particles of 5 to 15 μm, for example, preferably 6 to 9 μm.

Thereafter the mixture is cooled, neutralized with acid, and thereafter filtrated, washed and dried, to obtain powder of the toner base particles.

In order to neutralize the mixture, an aqueous solution of 0.5 to 12 N (normal), for example, preferably 0.5 to 2 N (normal), is prepared from inorganic acid such as hydrochloric acid, sulfuric acid or nitric acid, for example, and added to the mixture in the ratio of 0.1 to 10 times, for example, preferably 0.3 to three times, of the mole number of the added aggregation terminator, and the suspension is thereafter stirred for 0.1 to 3 hours, preferably 0.5 to 1 hour, to fluidize the suspension.

(e) Blending of Additive

Then, a charge controller, an external additive etc. are added to the obtained toner base particles if necessary, to obtain the desired toner.

(Addition of Charge Controller)

As the charge controller, a positively chargeable charge controller or a negatively chargeable charge controller is employed alone or in combination correspondingly to the object and application of the toner.

The positively chargeable charge controller may be a nigrosine dye, a quaternary ammonium compound, an onium compound, a triphenylmethane compound, a basic group-containing compound or tertiary amino group-containing acrylic resin, for example.

The negatively chargeable charge controller may be a trimethylethane dye, an azo pigment, copper phthalocyanine, salicylic acid metal complex, benzilic acid metal complex, perylene, quinacridone or a metal complex azo dye, for example.

When adding the charge controller, a dispersion of the charge controller and the toner base particles are blended with each other, stirred, and thereafter filtrated and dried, to fixing the charge controller to the toner base particles, for example. The dispersion of the charge controller is prepared as a water dispersion containing 0.1 to 3 percent by weight of the charge controller, for example. The dispersion of the charge controller is added in the ratio of 0.1 to 5 parts by weight, for example, preferably in the ratio of 0.3 to 2 parts by weight, with respect to 100 parts by weight of the toner base particles.

Thus, the charge controller is fixed in the ratio of 0.1 to 5 parts by weight, for example, preferably in the ratio of 0.3 to 2 parts by weight, with respect to 100 parts by weight of the toner base particles.

(Addition of External Additive)

The external additive is added in order to adjust chargeability, fluidity and preservation stability of the toner, and contains submicron particles extremely smaller in particle diameter than the toner base particles.

The external additive may be inorganic particles or synthetic resin particles, for example.

The inorganic particles may be silica, aluminum oxide, titanium oxide, a silicon-aluminum cooxide, a silicon-titanium cooxide or a hydrophobicized substance thereof. For example, a hydrophobicized substance of silica can be obtained by treating fine powder of silica with silicone oil or a silane coupling agent (dichlorodimethylsilane, hexamethyldisilazane or tetramethyldisilazane, for example).

The synthetic resin particles may be methacrylate ester polymer particles, acrylate ester polymer particles, styrene-methacrylate ester copolymer particles, styrene-acrylate ester copolymer particles, or core-shell particles containing cores of a styrene polymer and shells of a methacrylate polymer, for example.

When adding the external additive, the toner base particles and the external additive are stirred and mixed with a high-speed stirrer such as a Henschel mixer, for example. The external additive is generally added in the ratio of 0.1 to 6 parts by weight with respect to 100 parts by weight of the toner base particles, for example.

Thereafter the mixture is passed through a prescribed sieve, to obtain the toner.

(3) Toner

The obtained toner has a contact angle of not less than 70°, for example, preferably not less than 80°, and a water retention change ratio of not more than 0.55%, for example, preferably not more than 0.4%. The contact angle can be measured with a well-known contact angle meter. In order to measure the water retention change ratio, the toner is first left in an environment having a temperature of 20° C. and relative humidity of 10%, and weighed after 24 hours and 48 hours respectively, to calculate the average value thereof as the toner weight (wL) in a low-temperature low-humidity environment. Then, the toner is left in an environment having a temperature of 32.5° C. and relative humidity of 80%, and weighed after 24 hours, 48 hours and 72 hours respectively, to calculate the average value thereof as the toner weight (wH) in a high-temperature high-humidity environment. Then, the water retention change ratio is calculated as follows:

$$\text{Water Retention Change Ratio}=(wH-wL)/wL\times 100(\%)$$

2. Structure of Developing Apparatus

Figure 2:
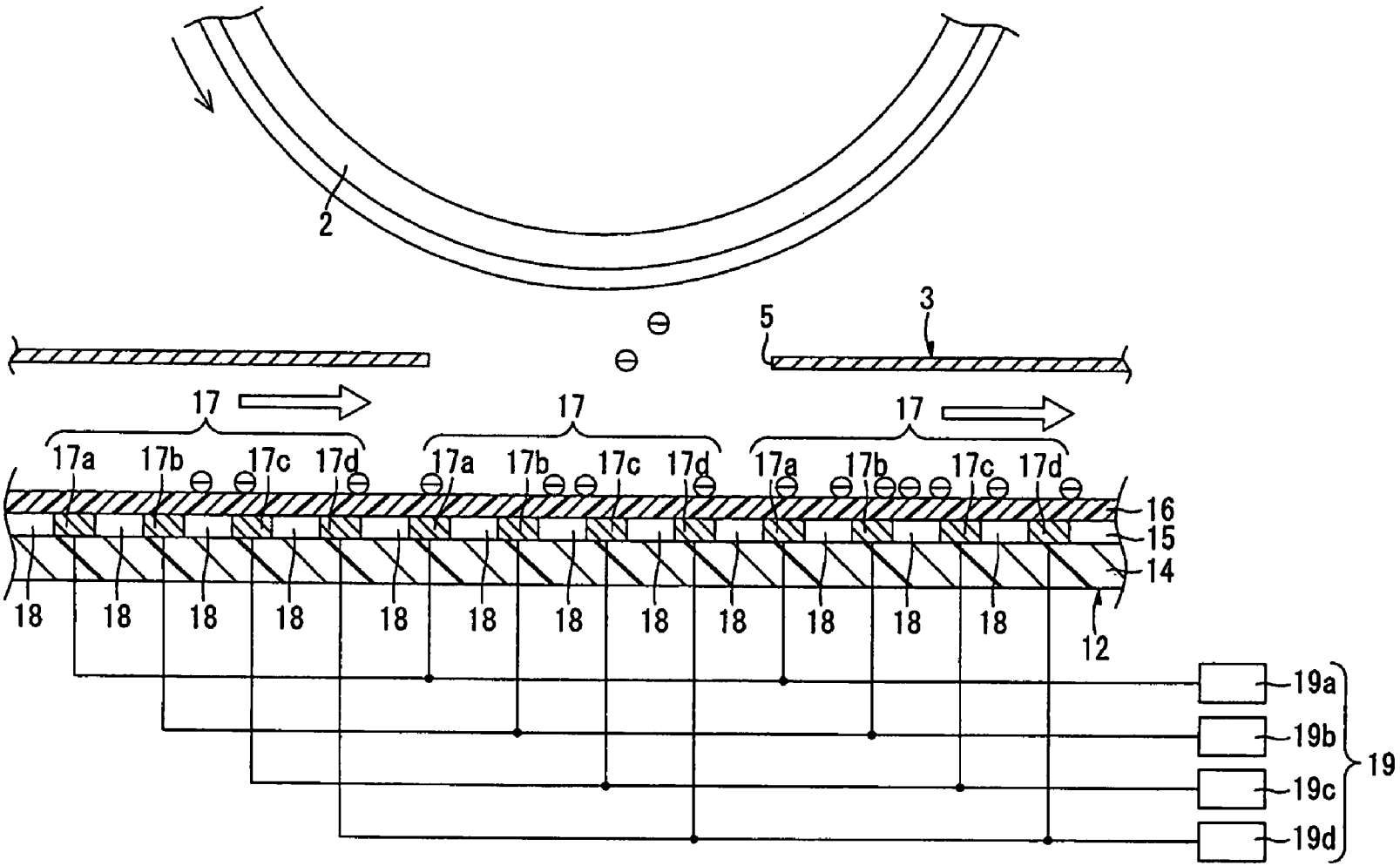
FIG. 2 is an enlarged sectional view of a principal part of the developing apparatus shown in FIG. 1.
Figure 3:
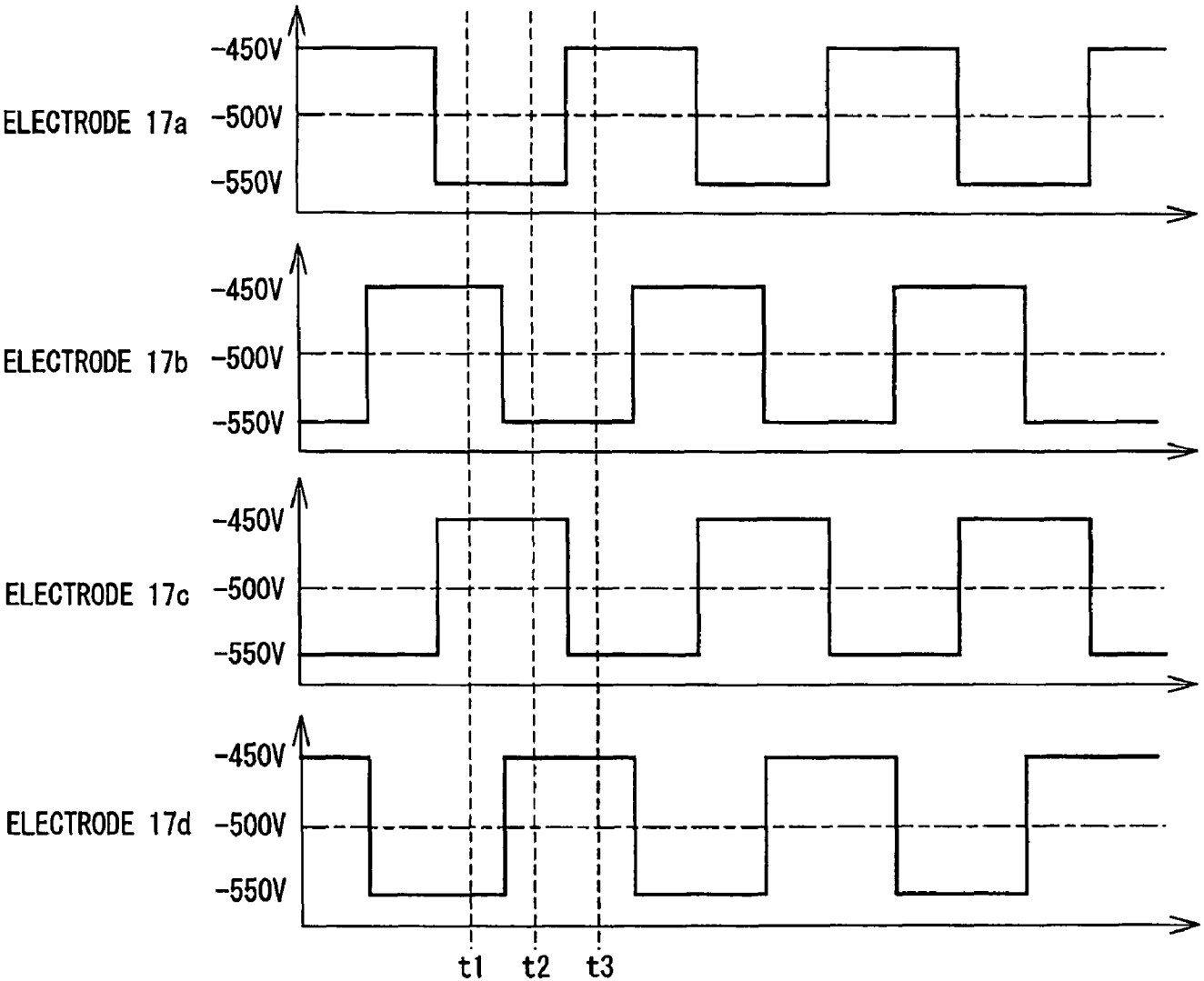
FIG. 3 is an explanatory diagram showing the waveforms of voltages generated by power circuits in the developing apparatus shown in FIG. 1.

FIG. 1 is a schematic side sectional view showing an embodiment of a developing apparatus according to the present invention. FIG. 2 is an enlarged sectional view of a principal part of the developing apparatus shown in FIG. 1. FIG. 3 is an explanatory diagram showing the waveforms of voltages generated by power circuits in the developing apparatus shown in FIG. 1.

Referring to FIG. 1, this developing apparatus 1 is provided for feeding a toner to an electrostatic latent image carrier (FIG. 1 specifically illustrates a photosensitive drum 2) carrying an electrostatic latent image in an image forming apparatus such as a laser printer. This developing apparatus 1 includes a casing 3 and a transport member 4.

The casing 3 is in the form of a box provided with an opening 5 on a portion opposed to the photosensitive drum 2. The casing 3 includes an upper plate 6, a bottom plate 7 and side plates 8.

The photosensitive drum 2 is arranged above the casing 3, and the upper plate 6 is opposed to the photosensitive drum 2 at an interval in the up and down direction. The upper plate 6 is provided with the opening 5 opposed to the photosensitive drum 2. The opening 5 is so opened in the upper plate 6 as to extend along the axial direction of the photosensitive drum 2. The bottom plate 7 is opposed to the upper plate 6 from below, and inclined from one end toward the other end in a direction orthogonal to the axial direction of the photosensitive drum 2. Thus, the casing 3 is provided with a deep storage section 9 and a shallow reflux section 10 on the other and one sides respectively. The side plates 8 are so provided as to couple the peripheral end portions of the upper plate 6 and the bottom plate 7 with each other.

The transport member 4 is formed generally in an inverted U-shape in side view, to extend in the axial direction of the photosensitive drum 2. The transport member 4 integrally includes a carry-in plate 11, a feed plate 12 and a carry-out plate 13.

The lower end portion of the carry-in plate 11 is arranged in the storage section 9 in the vicinity of the bottom plate 7, while the upper end portion of the carry-in plate 11 is arranged in the vicinity of the upper plate 6 on a position closer to the other end than the opening 5. Thus, the carry-in plate 11 is inclined from the lower end portion toward the upper end portion from the storage section 9 toward the other end beyond the opening 5.

The feed plate 12 is arranged generally parallelly to the upper plate 6 in the vicinity of the lower portion of the upper plate 6, to be opposed to the opening 5 in the up and down direction. The feed plate 12 is so provided as to extend toward the other side beyond the opening 5 and to extend toward the one side beyond the opening 5. One end portion of the carry-in plate 11 is connected to the other end portion of the feed plate 12. The other end portion of the carry-out plate 13 is connected to one end portion of the feed plate 12.

The upper end portion of the carry-out plate 13 is arranged in the vicinity of the upper plate 6 on a position closer to the one end portion beyond the opening 5, and the lower end portion of the carry-out plate 13 is arranged in the reflux section 10 in the vicinity of the bottom plate 7. Thus, the carry-out plate 13 is inclined from the upper end portion toward the lower end portion from a portion closer to the one end portion beyond the opening 5 toward the reflux section 10.

The transport member 4 includes a substrate layer 14, an electrode layer 15 and a surface layer 16, as shown in FIG. 2. The electrode layer 15 is stacked on the substrate layer 14, and the surface layer 16 is stacked on the electrode layer 15.

The substrate layer 14 is made of insulating synthetic resin. The electrode layer 15 includes a plurality of electrodes 17 (hereinafter referred to as electrodes 17*a*, 17*b*, 17*c* and 17*d* when the electrodes 17 are distinguished from one another) and interelectrode insulating layers 18 interposed between the electrodes 17.

The electrodes 17 are in the form of flat plates, and arranged at intervals from one another along the extensional direction of the transport member 4. More specifically, the electrodes 17*a*, 17*b*, 17*c* and 17*d* are successively repetitively arranged along the extensional direction of the transport member 4. Power circuits 19 (hereinafter referred to as power circuits 19*a*, 19*b*, 19*c* and 19*d* when the power circuits 19 are distinguished from one another) are connected to the electrodes 17 respectively. More specifically, the power circuit 19*a* is connected to the electrodes 17*a*, the power circuit 19*b* is connected to the electrodes 17*b*, the power circuit 19*c* is connected to electrodes 17*c*, and the power circuit 19*d* is connected to the electrodes 17*d*.

The interelectrode insulating layers 18 are made of insulating synthetic resin, and filled between the adjacent electrodes 17 along the extensional direction of the transport member 4.

The surface layer 16 is applied to the surface of the electrode layer 15. The surface layer 16 is made of a material such as nylon or polyester, capable of charging the toner to negative polarity due to friction (contact) between the surface layer 16 and the toner.

In this developing apparatus 1, the casing 3 stores the aforementioned toner. The toner is filled in the casing to fill up at least the lower end portion of the carry-in plate 11.

3. Operation of Developing Apparatus

When supplied with power to the power circuits 19 in the developing apparatus 1, generate voltages having rectangular waveforms of a constant cycle with an average voltage of a prescribed negative voltage (−500 V, for example), as shown in FIG. 3. The waveforms of the voltages generated by the power circuits 19 are out of phase by 90° with one another. In other words, the phases of the voltages directed from the power circuit 19*a* toward the power circuit 19*d* lag by 90°.

Thus, the electrode 17*a* connected to the power circuit 19*a* has a lower potential than the electrode 17*b* connected to the power circuit 19*b* at a time t1, for example, as shown in FIG. 3, whereby an electric field opposite to the transport direction (from the other side toward the one side) is formed on the surface layer 16 between the electrodes 17*a* and 17*b*. Thus, the negatively charged toner moves in the transport direction due to electrostatic force in the transport direction.

The electrode 17*b* connected to the power circuit 19*b* and the electrode 17*c* connected to the power circuit 19*c* are equipotential. On the surface layer 16 between the electrodes 17*b* and 17*c*, therefore, electric fields in the transport direction and the opposite direction thereof are weak, to hardly cause movement of the toner.

The electrode 17*c* connected to the power circuit 19*c* has a higher potential than the electrode 17*d* connected to the power circuit 19*d*, whereby an electric field in the transport direction is formed on the surface layer 16 between the electrodes 17*c* and 17*d*. Thus, the negatively charged toner moves in the direction opposite to the transport direction due to electrostatic force in the transport direction.

The electrode 17*d* connected to the power circuit 19*d* and the electrode 17*a* connected to the power circuit 19*a* are equipotential. On the surface layer 16 between the electrodes 17*d* and 17*a*, therefore, electric fields in the transport direction and the opposite direction thereof are weak, to hardly cause movement of the toner.

Consequently, the negatively charged toner is collected on the surface layer 16 between the electrodes 17*b* and 17*c* at the time t1.

At a time t2, the negatively charged toner is collected on the surface layer 16 between the electrodes 17*c* and 17*d*, similarly to the above. At a time t3, the negatively charged toner is collected on the surface layer 16 between the electrodes 17*d* and 17*a*.

Thus, the position where the negatively charged toner is collected moves on the surface layer 16 along the transport direction with the elapse of time. In other words, a traveling wave electric field is formed on the surface layer 16 due to the voltages successively applied from the respective power circuits 19 to the electrodes 17. Therefore, the toner stored in the storage section 9 is transported from the lower end portion toward the upper end portion of the carry-in plate 11, then transported from the other end toward the one end of the feed plate 12, and thereafter transported from the upper end portion toward the lower end portion of the carry-out plate 13, to be transported to the reflux section 10. The toner transported to the reflux section 10 is gradually returned to the storage section 9 along the inclination of the bottom plate 7, due to its own weight.

In the aforementioned transportation, the surface layer 16 is made of the material charging the toner to negative polarity through friction. Therefore, the toner is negatively charged when the same is transported from the carry-in plate 11 to the feed plate 12 to reach an intermediate portion of the feed plate 12 opposed to the opening 5.

On the other hand, an electrostatic latent image based on image data is formed on the surface of the photosensitive drum 2. In other words, the surface of the photosensitive drum 2 has a charged region charged to a reference potential (−1000 V, for example) by a charger (not shown) and an exposed region exposed to 0 V by scanning with a laser beam. The potential of each electrode 17 is set to a level (−550 V to −450 V) higher than the reference potential.

Therefore, the toner opposed to the charged region of the photosensitive drum 2 on the surface layer 16 of the feed plate 12 is transported from the surface layer 16 of the feed plate 12 to the surface layer 16 of the carry-out plate 13 as such, due to electrostatic force directed from the surface of the photosensitive drum 2 toward the surface of the surface layer 16. On the other hand, the toner opposed to the exposed region of the photosensitive drum 2 on the surface layer 16 of the feed plate 12 is fed from the surface of the surface layer 16 to the surface of the photosensitive drum 2 due to electrostatic force directed from the surface of the surface layer 16 to the surface of the photosensitive drum 2. Thus, the exposed portion is developed, and a toner image is carried on the surface of the photosensitive drum 2. The image forming apparatus thereafter forms an image on a sheet by transferring the toner image from the surface of the photosensitive drum 2 to the sheet with a transfer roller (not shown) and fixing the same.

4. Function/Effect of Developing Apparatus

According to the aforementioned developing apparatus 1, the activity of the toner stored in the casing 3 is not more than $2.0\times10^{-6}$ mol/g, whereby the toner can be transported as such by the traveling wave electric field formed on the transport member 4 without precharging by an agitator or the like, for example. Thus, friction caused on the transported toner can be remarkably reduced, whereby the toner can be effectively prevented from deterioration.

EXAMPLES

The present invention is now described with reference to examples and comparative examples. In the following description, "parts" and "percent" are those by weight unless otherwise stated.

1) Preparation of Toner (Preparation of Slurry)

180 g of each polyester resin a shown in Table 1, 720 g of methyl ethyl ketone (MEK) and 13.5 g of each additive b shown in Table 1 were introduced into a plastic vessel of 1 L. Thereafter the entire vessel was shaken with a turbuler mixer for 30 minutes, and a magnetic stirrer was thereafter introduced into the vessel for stirring the mixture for 30 minutes. When gel was formed, the mixture was forcibly stirred and dispersed with a homogenizer (DIAX 900 by Heidolph shaft generator 25F) at 8000 rpm. Thus, the polyester resin was dissolved into the MEK, to prepare an MEK solution.

900 g of distilled water and sodium hydroxide of 1 N in each content c shown in Table 1 were introduced into a beaker of 1 L and mixed with each other, to prepare an aqueous solution.

The MEK solution and the aqueous solution were introduced into a beaker of 2 L and stirred and dispersed with the aforementioned homogenizer at 1100 rpm for 20 minutes, to prepare an emulsion.

The emulsion was introduced into a round flask of 2 L dipped in a water bath of 60° C. and stirred with a crescent mixing blade at 120 rpm for 4 hours, and slurry was prepared by evaporating the MEK. At this time, the MEK was naturally evaporated for the first 1 hour, and thereafter evaporated for 3 hours while ventilating the surface of the emulsion with a fan.

After the stirring, the slurry was filtrated for separating coarse particles, transferred to a beaker of 1 L, and cooled to not more than 30° C. while rapidly stirring the same.

Thereafter the slurry was left overnight, and the solid content thereof was measured. More specifically, about 1 g of the slurry was collected in an aluminum vessel, and moisture was evaporated. The solid concentration of the slurry was calculated by dividing the weight of the residue by the weight of the collected slurry. The slurry was diluted with distilled water so that the solid concentration thereof was 20%.

(Preparation of Aggregated Particles)

80 g of an aqueous solution prepared by diluting each defoaming agent e shown in Table 2 to a proper concentration, and aqueous sodium hydroxide solution of 0.2 N in each content f shown in Table 2, if necessary, were introduced into a beaker of 500 mL and mixed and stirred with a magnetic stirrer, to prepare 80 g of an aqueous defoaming solution.

80 g of each slurry d shown in Table 2 was introduced into a separable flask of 200 mL, aqueous aluminum chloride solution of 0.2 N in each content g shown in Table 2 was added thereto, and these were mixed and stirred with a homogenizer at 8000 rpm for 5 minutes, to be homogeneously mixed with each other entirely.

Then, the aqueous defoaming solution was introduced into the separable flask and mixed with the slurry. Ultrasonic waves (28 kHz: 650 W) were applied for 5 minutes, while the mixture was loosely stirred with a spatula to reduce bubbles.

Thereafter the separable flask was dipped in a water bath set to 50° C., and the mixture was stirred with an impeller (six flat turbine blades: ϕ75×10 mm: double-ply) at each rotational frequency h shown in Table 2. After a lapse of 10 minutes from the beginning of the stirring, aqueous sodium hydroxide solution of 0.2 N was added to the mixture in each content i shown in Table 2, if necessary, and the mixture was continuously stirred at each rotational frequency j shown in Table 2. Referring to Table 2, 140 rpm, 180 rpm and 400 rpm correspond to tip circumferential velocities of 0.55 m/s, 0.70 m/s and 1.6 m/s respectively.

After a lapse of each time k shown in Table 2, aqueous sodium hydroxide solution of 0.2 N was added in each content l shown in Table 2, and the set temperature of the water bath was changed to 60° C.

After a lapse of each time m shown in Table 2, the set temperature of the water bath was changed to 95° C., and the mixture was further continuously stirred for each time n shown in Table 2.

A cylindrical vessel (ϕ200, height: 50 mm) having an open upper portion and including a sieve with a 250 μm mesh on the bottom, another cylindrical vessel having an open upper portion and including a sieve with a 150 μm mesh on the bottom, and still another cylindrical vessel having an open upper portion and including no sieve on the bottom were serially arranged on a sieve vibrator (Octagon 200) successively from above.

The stirred toner particles were stood on the sieve with the 250 μm mesh and thereafter vibrated for 15 minutes to pass through the sieves, thereby obtaining each of toners A to G shown in Table 2.

Table 1

TABLE 1

| Slurry no. | Polyester Resin a | Additive b | c(g) |
|---|---|---|---|
| Slurry 1 | FC1565 | WAXM-77 | 9 |
| Slurry 2 | XPE2443 | WAXM-77 | 4.5 |

FC1565: by Mitsubishi Rayon Co., Ltd., glass transition point (Tg): 61.9° C., acid value: 4.4 mgKOH/g, weight-average molecular weight (Mw): 70000, gel content: 0%

XPE2443: by Mitsui Chemicals, Inc., glass transition point (Tg): 61.3° C., acid value: 2 mgKOH/g, weight-average molecular weight (Mw): 81300, gel content: 17.4%

WAXM-77: carbon-containing wax by Morimura Chemicals Ltd.

Table 2

TABLE 2

| Toner No. | Slurry d | Defoaming Agent e | f (g) | g (g) | h (rpm) | i (g) | j (rpm) | k (min.) | l (g) | m (min.) | n (min.) |
|---|---|---|---|---|---|---|---|---|---|---|---|
| A | Slurry 2 | Neugen XL70(0.4% aq.) | 1 | 2.2 | 400 | 0 | 400 | 20 | 2 | 30 | 360 |
| B | Slurry 1 | Neugen XL70(0.4% aq.) | 1 | 3 | 400 | 0 | 400 | 20 | 4 | 30 | 240 |
| C | Slurry 1 | Neugen XL50(0.4% aq.) | 1 | 3 | 400 | 0 | 400 | 20 | 3 | 30 | 90 |
| D | Slurry 1 | Neugen XL70(0.4% aq.) | 1 | 3 | 400 | 0 | 400 | 30 | 3 | 30 | 90 |
| E | Slurry 1 | Neugen XL50(0.4% aq.) | 0 | 3 | 180 | 4 | 140 | 60 | 2 | 30 | 120 |
| F | Slurry 1 | Neugen TDS80(0.4% aq.) | 0 | 3 | 180 | 4 | 140 | 60 | 2 | 30 | 120 |
| G | Slurry 1 | Neugen EA137(0.4% aq.) | 0 | 3 | 180 | 4 | 140 | 35 | 2 | 60 | 120 |

Then, the resulting suspension was transferred from the separable flask to a beaker of 200 mL, and the beaker was dipped in cool water, to cool the suspension to not more than 30° C. while stirring the same with a magnetic stirrer. The suspension was left overnight, to precipitate the toner on the bottom of the beaker and remove the supernatant fluid. Distilled water was added in a quantity corresponding to the removed supernatant fluid, and the mixture in the beaker was stirred to disperse the particles. Further, 4.5 g of hydrochloric acid of 1 N was added to the mixture, which was stirred with a magnetic stirrer for 30 minutes. Thereafter the mixture was left for 30 minutes, and softly filtrated from the supernatant fluid. After the particle dispersion in the beaker was entirely filtrated, 500 g of distilled water was added to wash the filtration residue. The filtration residue was dried in a drier of 50° C. for 5 days, for obtaining toner base particles.

(Addition of External Additive)

Fine powder of silica HVK 2510 (by Clariant) was externally added to the obtained toner base particles by the following method.

145 g of the toner base particles and 1.45 g of HVK 2510 were charged in a high-speed stirrer Mechano Mill (by Okada Seiko Co., Ltd.), and stirred at 2500 rpm for 5 minutes.

Neugen EA137: styrenated phenol ether nonionic surfactant by Dai-ichi Kogyo Seiyaku Co., Ltd.

Neugen TDS80: higher alcohol ether nonionic surfactant by Dai-ichi Kogyo Seiyaku Co., Ltd.

Neugen XL50: higher alcohol ether nonionic surfactant by Dai-ichi Kogyo Seiyaku Co., Ltd.

Neugen XL70: higher alcohol ether nonionic surfactant by Dai-ichi Kogyo Seiyaku Co., Ltd.

2) Measurement of Activity of Toner (Preparation of Sample Solution)

A magnetic stirrer was introduced into a beaker of 50 mL, and the tare weight was accurately measured. 1 g of each toner obtained in the above was taken on a charta, and the input (g) of the toner was calculated by introducing the toner into the beaker, accurately measuring the total weight and thereafter subtracting the tare weight from the total weight (see Table 3).

3 mL of aqueous benzethonium chloride solution of 0.003718 mol/L was added to the toner with a potentiometric titrator AT-510 (by Kyoto Electronics Manufacturing Co., Ltd.), to dip the toner in the aqueous benzethonium chloride solution. Thereafter the total weight of the aqueous benzethonium chloride solution containing the toner was accurately measured. Thereafter the mixture was shaken with application of ultrasonic waves (28 kHz, 650 W), to disperse the toner in the aqueous benzethonium chloride solution.

Then, 30 ml of distilled water was added to the mixture, the total weight of the mixture was accurately measured, and the input (ml) of water was calculated by subtracting the total weight of the aqueous benzethonium chloride solution containing the toner. Then, the mixture was stirred with a magnetic stirrer for 30 minutes to entirely fluidize the liquid, and the quantity (ml) of evaporated water was thereafter calculated by accurately measuring the total weight of the mixture.

Thereafter the entire liquid was filtrated through a cellulose acetate membrane filter of 0.8 μm, the filtrate was received in a previously weighed beaker of 100 mL, and the volume of the filtrate was calculated by weighing the beaker immediately after the filtration (see Table 3). Thereafter distilled water was added up to the scale of 100 mL of the beaker, and the mixture was stirred to prepare the sample solution.

(Back Titration)

Each sample solution was back-titrated with aqueous LAS (sodium lauryl sulfate) solution of 0.00133 M. Table 3 shows each titer of LAS. The back titration was performed with the potentiometric titrator AT-510 (by Kyoto Electronics Manufacturing Co., Ltd.) under the following conditions:

waiting time: 300 sec., cutoff time: 5 sec., unit volume: 0.1 mL, dispensing speed: 10 sec/ml (Calculation)

The activity of polar groups on the surface of the toner was calculated from the titer of LAS.

First, a mole number W (mol) of LAS consumed by the titration was calculated from the following equation (1):

$$W=0.00133\times(\text{titer(mL) of LAS}/1000) \quad (1)$$

Then, a total weight T (g) before the filtration was calculated from the following equation (2), and a mole number X (mol) of the benzethonium chloride contained before the filtration was calculated from the following equation (3). The input of the aqueous benzethonium chloride solution was assumed to be 3 ml.

$$T=3(\text{ml})+(\text{input(ml) of water}-\text{quantity(ml) of evaporated water}) \quad (2)$$

$$X=W(\text{mol})\times T(\text{ml})/\text{volume(ml) of filtrate} \quad (3)$$

Then, the mole number X (mol) of the benzethonium chloride contained before the filtration was subtracted from the mole number (mol) of the initially added benzethonium chloride, thereby calculating a mole number Y (mol) of the benzethonium chloride consumed by reaction with the polar groups from the following equation (4):

$$Y=0.003718(\text{mol/L})\times 3(\text{ml})/1000-X \quad (4)$$

Finally, the mole number Y (mol) of the benzethonium chloride consumed by reaction with the polar groups was converted to a value per unit weight, and this value was calculated as an activity Z of the toner. Table 3 shows the results.

$$Z=Y(\text{mol})/\text{input(g) of toner}$$

3) Evaluation of Toner (A) Evaluation of Transportability (1) Transport Plate

Figure 4:
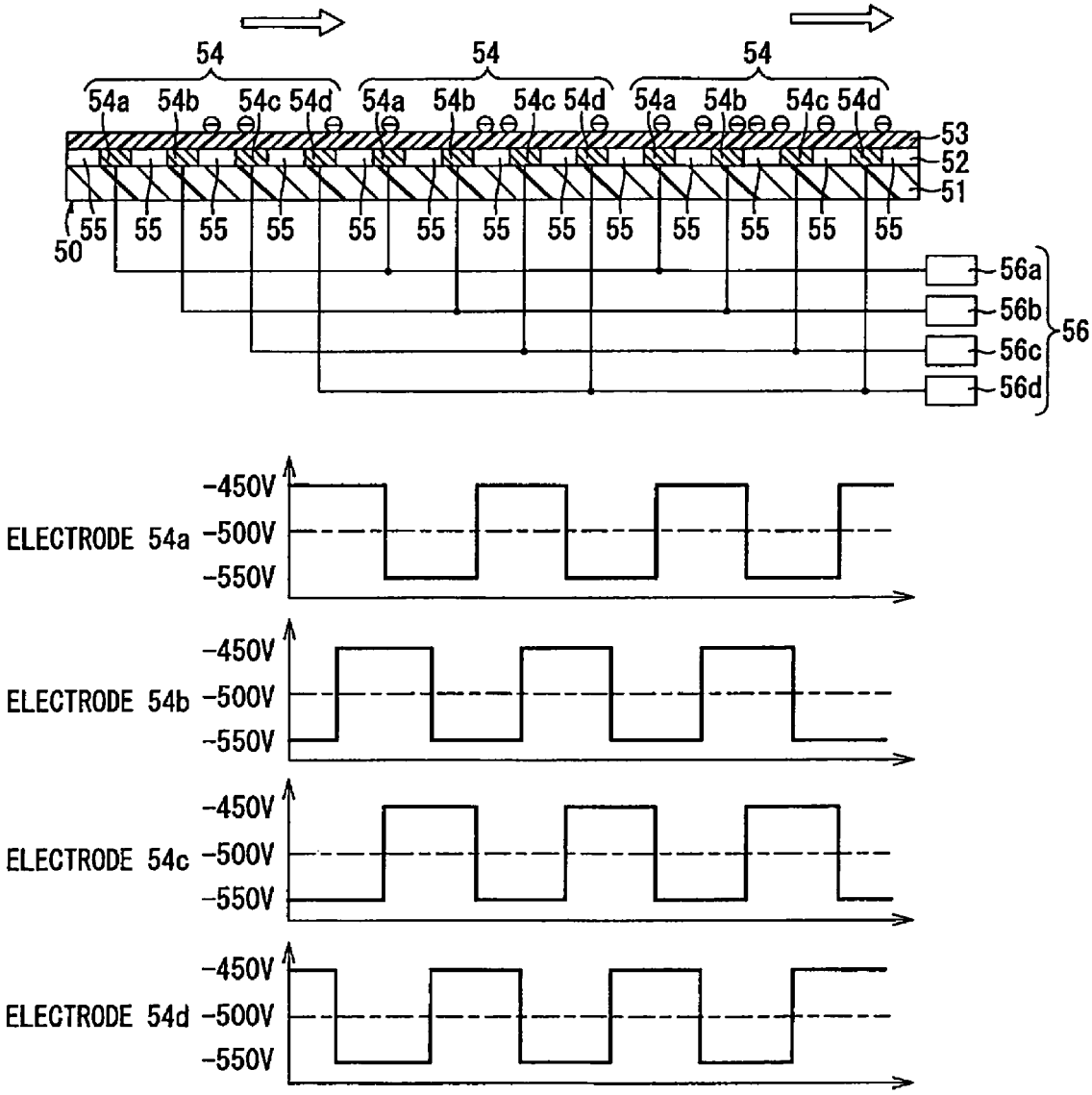
FIG. 4 is a schematic explanatory diagram of a transport plate employed for evaluating transportability.

A transport plate 50 of 15 cm in length composed of three layers, i.e., a substrate layer 51, an electrode layer 52 and a surface layer 53 was prepared as shown in FIG. 4.

The substrate layer 51 was made of insulating synthetic resin. The electrode layer 52 was formed by four types of electrodes 54*a*, 54*b*, 54*c* and 54*d* repetitively arranged at intervals in the transport direction and interelectrode insulating layers 55 filled between these electrodes 54. The surface layer 53 was formed by applying a polyester resin solution to the surface of the electrode layer 52 and thereafter drying the same. Power circuits 56*a*, 56*b*, 56*c* and 56*d* were correspondingly connected to the electrodes 54*a*, 54*b*, 54*c* and 54*d* respectively.

(2) Evaluation of Transportability 15 g of each toner was placed on one end of the surface layer 53, and power was supplied to the power circuits 56 for generating voltages having rectangular waveforms of a constant cycle with an average voltage of −500 V on the electrodes 54 (see FIG. 4). The waveforms of the voltages generated by the power circuits 56 were out of phase by 90° with one another. In other words, the phases of the voltages directed from the power circuit 56*a* toward the power circuit 56*d* lagged by 90°. Thus, a traveling wave electric field shown by arrows in FIG. 4 was formed on the surface layer 53 due to the voltages successively applied from the power circuits 56 to the electrodes 54.

Table 3 shows the results. Referring to Table 3, each mark "GOOD" shows a case where the toner was entirely transported from the one end to the other end of the surface layer 53, and each mark "NG" shows a case where the toner remained completely unmoving on the one end of the surface layer 53.

(B) Evaluation of Contact Angle

About 2.5 g of each toner was charged into Briquetting Press Type Bre-30 (by Maekawa Testing Machine) and pressurized at 180 kN for 2 minutes, to be molded into a tablet of ϕ40 mm×about 2.5 mm.

Then, the tablet was set on a measuring stand of Face automatic contact angle meter CA-V type (by Kyowa Interface Science Co., Ltd.), and a drop of distilled water was added thereto from a syringe of 1 mL. The syringe was equipped on the forward end thereof with a fluorinated 28-gauge needle. After 10 seconds from the addition of the distilled water, a side-elevational image of the droplet formed on the surface of the tablet was loaded into analytical software, to measure the contact angle. The tablet was moved to add another droplet to another measuring portion, and the contact angle was measured similarly to the above. The contact angle was calculated by averaging values measured on 13 portions. Table 3 shows the results.

(C) Evaluation of Water Retention Change Ratio

About 0.5 g of each toner was collected, introduced into a tray (L20×W20×H15 mm) and accurately weighed. Then, the toner was left in an environment (hereinafter referred to as an LL environment) of 20° C. and 10% of humidity and the weight was accurately measured after 24 hours and 48 hours respectively, to calculate the average value thereof as a toner weight wL in the LL environment.

Then, the toner was left in an environment (hereinafter referred to as an HH environment) of 32.5° C. and 80% of humidity and the weight was accurately measured after 24 hours, 48 hours and 72 hours respectively, to calculate the average value thereof as a toner weight wH in the HH environment.

The water retention change ratio was calculated from the following equation. Table 3 shows the results.

$$\text{Water Retention Change Ratio}=(wH-wL)/wL\times 100(\%)$$

Table 3

TABLE 3

| Example • Comparative Example | Toner No. | Input of Toner (g) | Total Weight before Filtration T(g) | Aqueous Benzethonium Chloride Solution (ml) | Filtrated Weight (g) | Titer of LAS (ml) | Mole Number of LAS W(mol) | Mole Number of Benzethonium Chloride before Filtration X(mol) |
|---|---|---|---|---|---|---|---|---|
| Example 1 | A | 1.0010 | 29.9227 | 3.0 | 30.8702 | 7.1030 | $9.47\times10^{-6}$ | $1.01\times10^{-5}$ |
| Example 2 | B | 1.0011 | 29.9049 | 3.0 | 27.9302 | 6.3640 | $8.49\times10^{-6}$ | $1.00\times10^{-5}$ |
| Example 3 | C | 1.0017 | 29.7440 | 3.0 | 28.0983 | 6.3111 | $8.41\times10^{-6}$ | $9.81\times10^{-6}$ |
| Example 4 | D | 1.0010 | 29.8341 | 3.0 | 27.3852 | 5.8292 | $7.77\times10^{-6}$ | $9.32\times10^{-6}$ |
| Comparative Example 1 | E | 1.0044 | 29.8924 | 3.0 | 27.9619 | 5.7778 | $7.70\times10^{-6}$ | $9.06\times10^{-6}$ |
| Comparative Example 2 | F | 1.0006 | 29.8135 | 3.0 | 26.6900 | 4.4501 | $5.93\times10^{-6}$ | $7.29\times10^{-6}$ |
| Comparative Example 3 | G | 1.0048 | 29.6973 | 3.0 | 26.5314 | 3.2357 | $4.31\times10^{-6}$ | $5.32\times10^{-6}$ |

| Example • Comparative Example | Mole Number of Benzethonium Chloride Y(mol) | Activity Z(mol/g) | Contact Angle (degree) | Water Retention Change Ratio (%) | Transport-ability |
|---|---|---|---|---|---|
| Example 1 | $1.05\times10^{-6}$ | $1.05\times10^{-6}$ | 81.8 | $4.25\times10^{-1}$ | GOOD |
| Example 2 | $1.16\times10^{-6}$ | $1.16\times10^{-6}$ | 77.2 | $5.36\times10^{-1}$ | GOOD |
| Example 3 | $1.35\times10^{-6}$ | $1.34\times10^{-6}$ | 74.5 | $5.35\times10^{-1}$ | GOOD |
| Example 4 | $1.83\times10^{-6}$ | $1.83\times10^{-6}$ | 70.0 | $5.53\times10^{-1}$ | GOOD |
| Comparative Example 1 | $2.09\times10^{-6}$ | $2.08\times10^{-6}$ | 69.3 | $5.70\times10^{-1}$ | NG |
| Comparative Example 2 | $3.86\times10^{-6}$ | $3.86\times10^{-6}$ | 68.8 | $5.48\times10^{-1}$ | NG |
| Comparative Example 3 | $5.84\times10^{-6}$ | $5.81\times10^{-6}$ | 66.8 | $6.01\times10^{-1}$ | NG |

The embodiments described above are illustrative and explanatory of the invention. The foregoing disclosure is not intended to be precisely followed to limit the present invention. In light of the foregoing description, various modifications and alterations may be made by embodying the invention. The embodiments are selected and described for explaining the essentials and practical application schemes of the present invention which allow those skilled in the art to utilize the present invention in various embodiments and various alterations suitable for anticipated specific use. The scope of the present invention is to be defined by the appended claims and their equivalents.

What is claimed is:

1. A developing apparatus comprising:

a transport member comprising a plurality of electrodes forming a traveling wave electric field by successively applied voltages; and a casing storing a toner transported by the transport member, wherein the toner comprises electrostatically active polar groups that enable the toner to be transported through the action of an electric field without the need for precharging the toner, as characterized by an activity of the toner based on the following measuring method shown in (1) to (3) of not more than $2.0\times10^{-6}$ mol/g:

(1) dipping the toner in an aqueous solution containing an excess equivalent of benzethonium chloride with respect to electrostatically active polar groups present on a surface of the toner to electrostatically react the polar groups and the benzethonium chloride with each other;

(2) adding sodium lauryl sulfate dropwise to the aqueous solution to react the same with the residual benzethonium chloride, thereby measuring a quantity of the sodium lauryl sulfate reacting with the residual benzethonium chloride; and (3) calculating the activity on the surface of the toner from the quantity of the reacting sodium lauryl sulfate.

2. The developing apparatus according to claim 1, wherein a contact angle of the toner is not less than 70°.

3. The developing apparatus according to claim 1, wherein a water retention change ratio of the toner is not more than 0.55%.

4. The developing apparatus according to claim 1, wherein the toner is obtained by a manufacturing method including the steps of:

preparing a suspension by emulsifying a resin solution, in which binder resin having anionic groups and a colorant are blended in an organic solvent, into an aqueous medium and thereafter removing the organic solvent; and aggregating and fusing the suspension by adding a aggregator to the suspension and thereafter adding alkali before a lapse of 10 minutes.

5. The developing apparatus according to claim 4, wherein the method further includes the step of agitating the suspension with an agitating blade at a peripheral velocity of not less than 1 m/s after the step of adding the alkali.

* * * * *